US005934848A

United States Patent [19]

Hämälainen

[11] Patent Number: 5,934,848

[45] Date of Patent: Aug. 10, 1999

[54] MACHINING OF THE SEALING SURFACE OF THE DOOR FRAME IN A COKE OVEN

[75] Inventor: Voitto Augusti Hämälainen, Lapaluoto, Finland

[73] Assignee: Rautaruukki Oy, Oulu, Finland

[21] Appl. No.: 08/880,826

[22] Filed: Jun. 23, 1997

[30] Foreign Application Priority Data

May 5, 1997 [FI] Finland ..... 971909

[51] Int. Cl.[6] ..... B23C 1/20

[52] U.S. Cl. ..... 409/178; 409/205

[58] Field of Search ..... 409/175, 178, 409/179, 201, 204, 205, 211, 235

[56] References Cited

U.S. PATENT DOCUMENTS

| | | | |
|---|---|---|---|
| 4,102,245 | 7/1978 | Cousins | 90/12 R |
| 4,658,485 | 4/1987 | Yang | 409/201 |
| 4,830,555 | 5/1989 | Conachen | 409/178 |
| 5,253,400 | 10/1993 | Conachen | 29/55 |
| 5,350,262 | 9/1994 | Michaelis et al. | 409/178 |
| 5,697,413 | 12/1997 | Fuller | 144/356 |
| 5,738,470 | 4/1998 | Sugita | 409/178 |
| 5,839,862 | 11/1998 | Hayashi et al. | 409/201 |

FOREIGN PATENT DOCUMENTS

| | | |
|---|---|---|
| 0351309 | 1/1990 | European Pat. Off. . |
| 3735527 | 4/1989 | Germany . |

*Primary Examiner*—Andrea L. Pitts
*Assistant Examiner*—Adesh Bhargava
*Attorney, Agent, or Firm*—Loeb & Loeb LLP

[57] ABSTRACT

The invention relates to machining equipment for machining the sealing surface (13) of the door frame (10) of a coke oven. The machining equipment comprises:

a frame (19) to which the machining device (23) is movably attached;

in the machining device means (27, 28) for moving at least one machining unit (1 and/or 2) relative to the frame in at least two directions (D1, D2), and in the machining unit a machine tool (3) including acutators (14); and means (20) for attaching the door frame and the machining device to each other while the door frame is being machined. In accordance with the invention the means (20) for attaching the door frame and the frame of the machining device to each other comprise fasteners (21) in the frame (19) of the machining device to connect the frame to attachment points (22) in the door frame (10) of the coke oven (60);

the machining device (23) comprises guide means (24) parallel to at least one side (11*a*, 11*b*) of the door frame and sledge means (26) movable on these in a first direction (D1); and said moving means of the first machining unit (1) comprise means (27) moving the sledge means in a first direction (D1) and means (28) moving the machine tools (3) in a second direction (D2) principally transverse to the direction of the guide means, the moving means (28) consisting of a uniform pivot plate (8) pivoting about the swivelling axis line (5) perpendicular to the plane (T) of the guide means and supporting the machine tools (3) and their actuators (14) and of its rotation gear (31). The invention also relates to a method using the machining equipment mentioned above.

10 Claims, 5 Drawing Sheets

MACHINING OF THE SEALING SURFACE OF THE DOOR FRAME IN A COKE OVEN

BACKGROUND OF THE INVENTION

1. Field of the Invention

The invention relates to machining equipment for machining the sealing surface of the door frame in a coke oven, the machining equipment comprising: a frame, in which the machining device is movably fixed; in the machining device means for moving at least one machining unit relative to the frame in at least two directions, and in the machining unit a machine tool and its actuating means; and means for fixing the door frame and the frame of the machining device to each other while the door frame is being machined. The invention also relates to a method for machining the sealing surface of the door frame of a coke oven by means of machining equipment of the type described above, with the door frame stationary in position to act as an edge of the opening of the coke oven.

2. Description of the Related Art

In metallurgical coke production, narrow, long and high ovens are used, which are connected in parallel to form a battery of several tens of coke ovens. The operation and design of such ovens for the production of metallurgical coke are described, among other publications, in *The Making, Shaping and Treating of Steel*, Lankford, Samways, Craven, McGannon; Association of Iron and Steel Engineers, 1985, Tenth Edition. Each individual coke oven of the coking plant usually has a height in the range of 1.8 to 7 m, a length in the range of 9 m to 16 m, and a width in the range of 30 cm to 60 cm. The coal is charged through openings at the top and is removed by a mobile pusher one oven at a time in the battery, by pushing pushing out the finished hot charge horizontally from the oven through an open door opening at the end of each individual coke oven. The ovens are heated for instance by burning gases in flues within the walls between said narrow individual ovens, the temperature of the oven walls being approx. 1300° C. At the ends of each individual oven of the battery, there are doors shaped to match the cross-section of the oven, e.g. with a length of ca. 7 m and a width of 0.7 m, and provided as covers with a lining of refractory material. The oven frame itself has a door frame, usually of cast iron, and surrounded by a precision-tooled sealing surface with a width of the order of 80 mm, the cover-like seal frame, consisting of a ca. 3–4 mm thick metal sheet, provided on the inner surface of the door, being pressed against the sealing surface. More specifically, the edge of this 3–4 mm thick seal frame is pressed like a knife against the sealing surface of the door, with the door in position in fasteners in the door frame.

The sealing surface of the door frame mentioned above will obviously wear and/or corrode in the course of time, so that the door no longer fits tightly against it. Usually the sealing surface of a new door frame has machining allowance for 1 to 3 repairs. It is well known that door frames are usually checked and overhauled at intervals of 2 to 5 years, or whenever leakage is observed. With conventional working methods, the repair of door frames is performed by removing the door while the oven is empty, but still warm, and the mouth of the oven is closed with a plugging door leaving the frame free, the frame to be repaired is removed and transported to be machined at a workshop, often situated far from the coking plant. The removed frame is replaced with a repaired replacement frame, the replacement period, i.e. the period over which the oven is empty, being from 8 to 10 hours. The work involves a great deal of installation, transport, waiting and other cost factors. In addition, the operations are onerous, given that the coke battery still is in continuous operation while being overhauled, in other words, the ovens immediately adjacent to the door frame to be serviced are still at the temperature mentioned above, approx. 1300° C. This long service period of 8 to 10 hours may cause overheating and thus damage to the empty oven unit, because the adjacent ovens have to be maintained at full operating temperature as described above in order to maintain production. Long servicing periods also reduce the output of the coking plant.

Other ways of machining the door frame of a coke oven have not even been proposed before, because any ordinary machine tools, such as a movable broaching machine, would interfere with the operation of the other ovens in the battery, and especially that of the pusher emptying the ovens. On the other hand, manual tools, such as a corner grinder, do not provide adequate precision for the sealing surface, and moreover, such operations are hampered by awkward working positions, hot circumstances, as mentioned above, while time exposed to weather conditions at the same time.

SUMMARY OF THE PREFERRED EMBODIMENT

Thus, the object of the invention is to provide machining equipment and a machining method which enable repair of the sealing surface of the door frame of a coke oven, i.e. remachining of a worn or corroded sealing surface so as to make it sufficiently planear with a minimum of work and loss of time. This also signifies that the oven in the coke battery whose door frame is being repaired will be rapidly fit for use again, allowing the overall production of the coking battery to remain as regular and intact as possible. A third object of the invention is such equipment and a method which interfere with the use and operation of the other ovens in the battery as little as possible.

The inconveniences above are eliminated and the goals defined above are achieved with working equipment in accordance with the invention, which is characterised by the features defined in the characterising clause of claim 1, and the method in accordance with the invention, which is charactersied by the features defined in the characterising clause of claim 10.

The chief advantage of the invention is that use of the device in accordance with the invention and adoption of the method in accordance with the invention suprisingly enable the door frame of a coke oven to be repaired while remaining in position at the end of the coke oven. Moreover, this allows the sealing surface of the door frame to be measured and repaired only at the necessary parts, which often constitute only half of the sealing surface or less. If the entire sealing surface is to be repaired by milling in accordance with the invention, the operation will require 5 to 7 hours, which is only half of the time required with the use of conventional means. If only partial machining is required, the repair of the sealing surface by milling in accordance with the invention will require only 3 to 4 hours. The invention has the further advantage of requiring the serviced oven to be empty for only 3 to 5 hours for instance, whereas conventional methods would require the oven to be empty for 8 to 10 hours. In this way, production loss is appreciably reduced, as is the risk of overheating of the oven masonry, given the far shorter empty period than with the use of conventional methods. The door frame remaining in position, its sealing surface can be machined with far greater accuracy to the right dimensions, because the temperature of the frame remains close to the actual operating temperature. In this situation, the machining allowance of the oven, typically ca. 12 mm, will allow for a greater number of repairs than with the use of conventional repair methods. In addition, the machining equipment and machining method in accordance with the invention save not only labour costs but also material expenses, since they do not require a set of replacement frames continuously recycled.

BRIEF DESCRIPTION OF THE DRAWINGS

The invention will be described in greater detail below with reference to the enclosed drawings.

DETAILED DESCRIPTION OF THE PREFERRED EMBODIMENT

Figure 5:
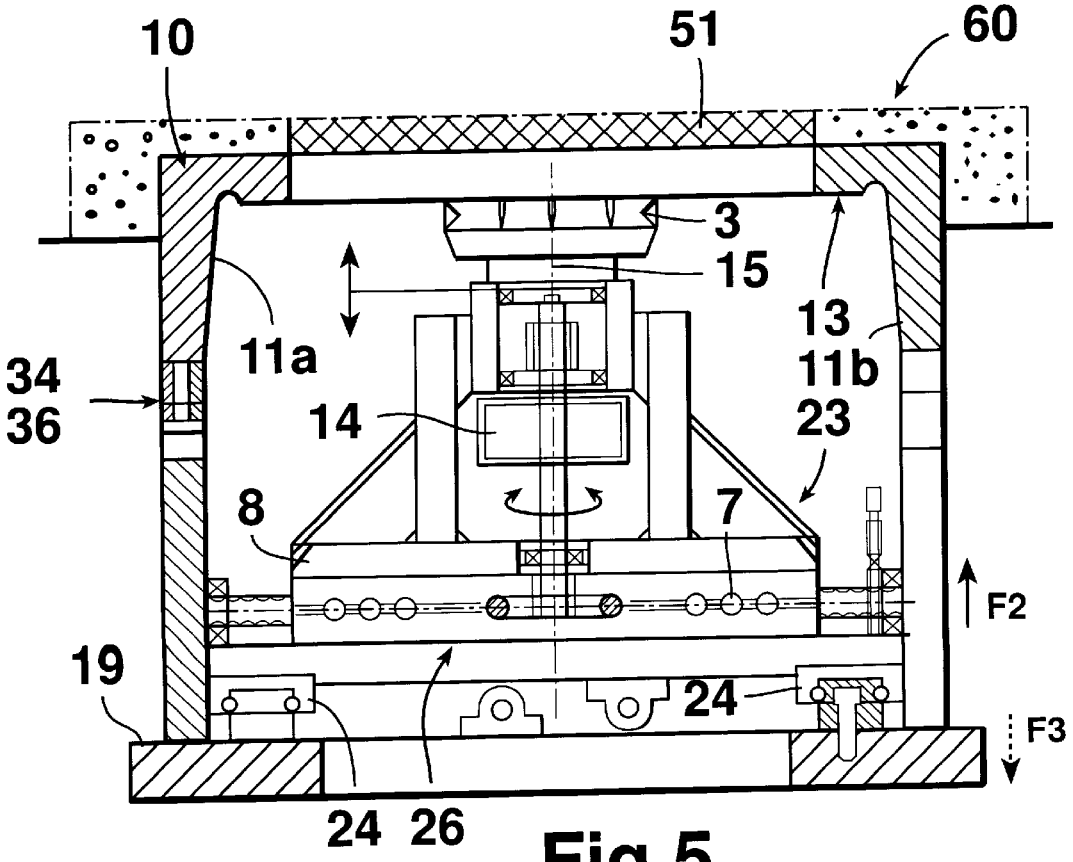
FIG. 5 shows the machining unit in accordance with the invention in operation in the direction of the sealing surface of the door frame to be machined, viewed as a section along plane II—II of FIG. 3.
Figure 6:
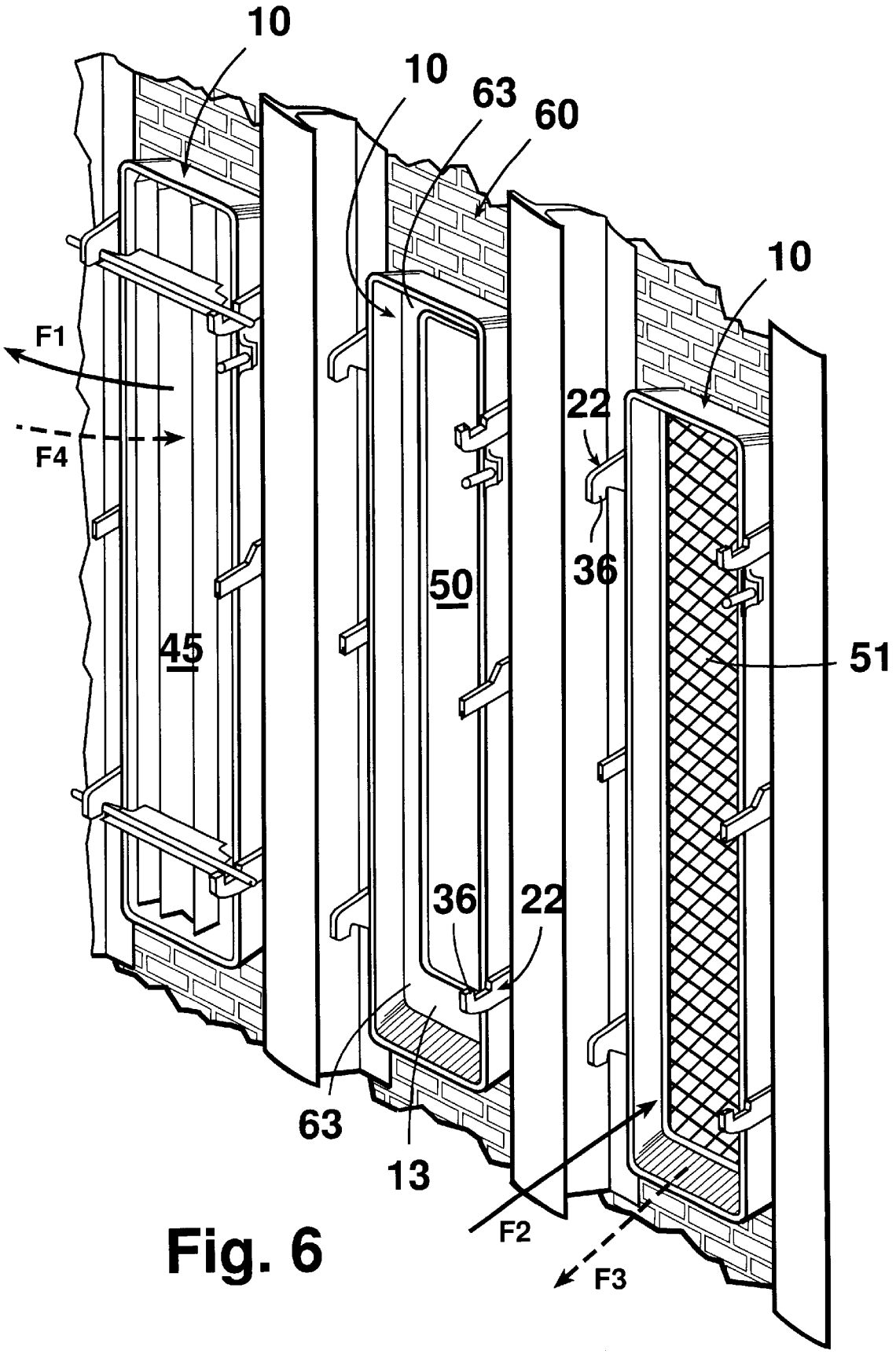
FIG. 6 shows part of the door openings of the coke ovens in the coke battery, schematically showing a normal coke oven door in position in the door opening of the left-hand coke oven, the door being removed and the oven opening open in the central coke oven, and in the right-hand coke oven, the opening of the door opening of the coke oven is closed with a plug to allow installation of the machining equipment in accordance with the invention.

Thus, FIG. 6 shows part of the openings 50 of the coke ovens 60 of the coking battery. The edge of the opening of each coke oven 60 consists of door frame 10, which, in accordance with the invention, remains in position in the opening of coke oven 60 while its sealing surface 13 is being repaired. The coke ovens may have the dimensions mentioned above. In the opening of the coke oven shown on the left side in FIG. 6, the door 45 of the coke oven is in position, as it is during the actual coking procedure. When the method of the invention is implemented and the machining device of the invention is used, the door 45 of the coke oven is first removed, as shown in FIG. 5 with arrow F1. Door frame 10 is allowed to remain in position to act as an edge of opening 50 of coke oven 60, as indicated at the central coke oven 60 in FIG. 6. In this case, opening 50 of the coke oven would be open. In normal operation of the coke oven, the coked charge is pushed out through this opening, or a device pushing out the charge of the coke oven is operated through this opening. In accordance with the invention, a plug-like element 51 is placed in opening 50 of the coke oven, the outer surface of the plug, appearing in FIG. 6, being placed deeper than the planear sealing surface 13 to be machined. The reason for this is to avoid damage to the machine tool, described in greater detail below, under the action of this plug-like element 51. The plug-like element 51 is not described in greater detail in this conjunction, and it may have any appropriate design which provides adequate seal and heat insulation of opening 50 of the coke oven.

Figure 1:
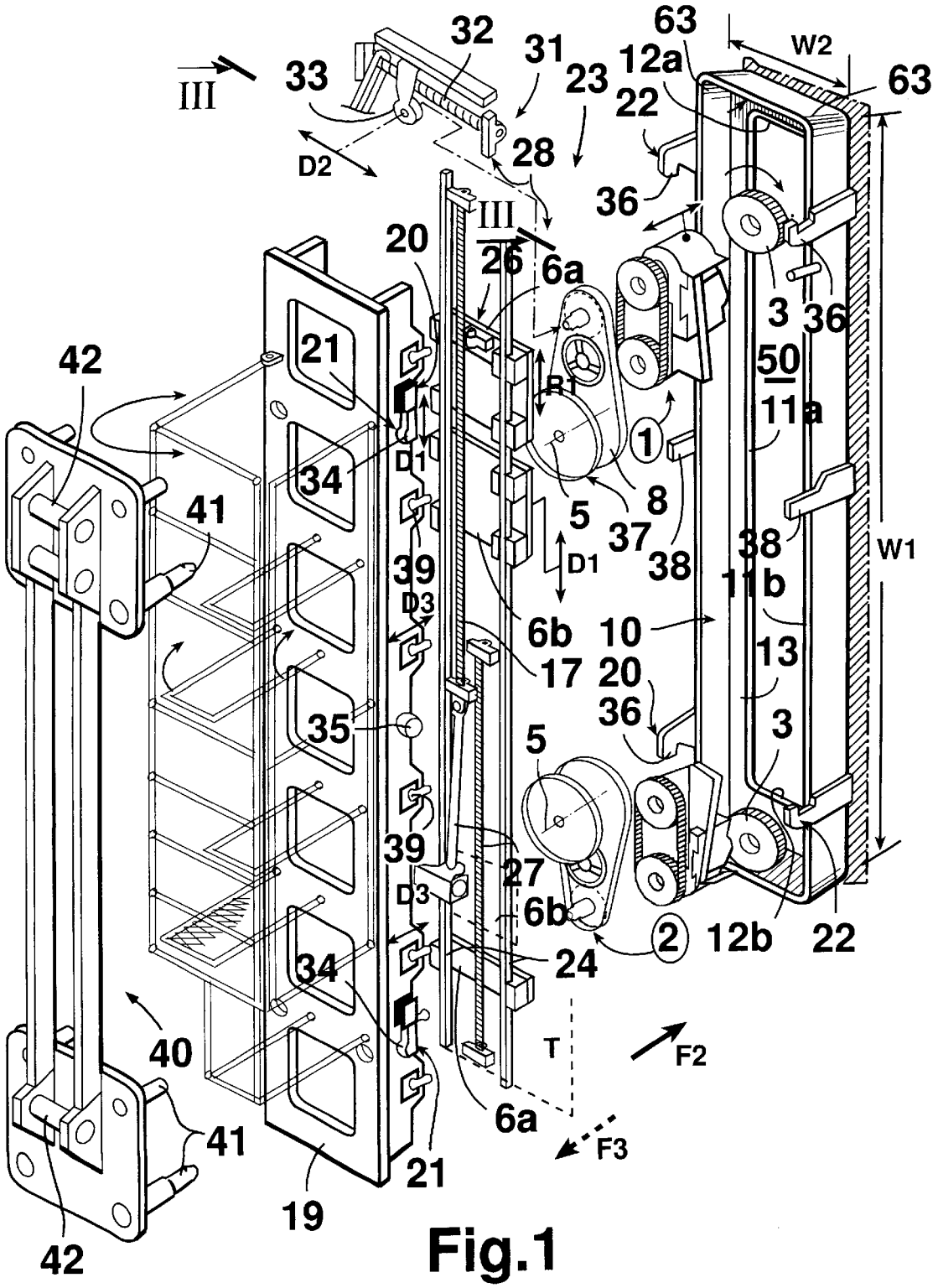
FIG. 1 shows the door frame in position in the door opening of a coke oven and an axonometric exploded view of the machining equipment in accordance with the invention.

Subsequently, oven opening 50 having been sealed with plug 51, machinining device 23, comprising at least one machining unit 1 and/or 2, is brought in the direction indicated with arrow F2, as shown in FIG. 1, to this door frame 10, and then the frame 19 of machining device 23 is fixed, in a manner described below, to door frame 10 while its sealing surface 13 is being machined. The design and the operation of the machining equipment in accordance with the invention are described in greater detail below. After the sealing surface 13 of the door frame has been machined by means of machinining device 23 with the desired accuracy so as to become planear, the used machinining device 23 is removed from door frame 10 along with its attachments and frame 19 used as a fastening, and taken elsewhere, as indicated with arrow F3 in FIGS. 1 and 6. After this, element 51 plugging oven opening 50 is removed, and then we are back in the situation of the central coke oven shown in FIG. 6, except that, unlike the starting situation, sealing surface 13 has been machined level in this case. After this, door 45 of the coke oven is brought into position in direction F4, as shown in FIG. 6, and is attached by ordinary door fastening mechanisms, which do not require further explanation here, to door frame 10. After these operations, coke oven 60 is ready for use again.

Before a more detailed description of the design of the machining equipment in accordance with the invention, we shall depict the design of the object of the invention, door frame 10, a little closer. First, the door frame has two vertical side edges 11*a* and 11*b* and side edges transverse to these, i.e. upper edge 12*a* and 12*b*. Hence, the door frame, when viewed in a direction perpendicular to its plane, is principally rectangular with rounded corners 63. Door frame 10 is made of metal and cast iron usually, its sealing surface 13 is planear and surrounds opening 50 of the coke oven. A seal edge of metal sheet, not shown in the figure, of door 45 is placed against this planear sealing surface 13. In addition, door frame 10 is provided with an adequately shaped edge flange 64, whose shape does not have any relevance for the machining equipment or method in accordance with the invention other than the attachment and control of the tool at the most. Attachment points 22 for the machining equipment are typically provided symmetrically at four points of the door frame. These attachment points 22, being for instance the attachment points of the door, are usually hook-like, as seen in FIG. 1 and FIG. 6. The attachment points may naturally be different. In addition, in most cases, the door frame has guides 38 perpendicular to the sealing surface 13, the guides being usable to position door 45 of the coke oven into exact position, but in any case necessary for the positioning of the machining-equipment of the invention into correct position during the machining operation.

Firstly, the machining equipment comprises a rigid frame 19, whose dimensions equal at least the height W1 and width W2 of the door frame 10. The actual machining device 23 is movably attached to this frame 19. The rigid frame 19 of the machining equipment also includes means 20 for attaching door frame 10 and the frame 19 of the machinining device immovably to each other while the sealing surface 13 of the door frame is being machined. Said fixing means 20 for attaching the door frame and the frame of the machining device to each other comprise fasteners 21 in the frame 19 of the machining device, fasteners 21 being used to connect frame 19 with the above door attachment points 22 in the door frame 10 of coke oven 60. These fasteners 21 consist of locking pins 34 movable in the height direction W1 of the door frame, and movable behind projections of the door fastening hooks 36 in the door frame such that frame 19 cannot move away from door frame 10, which is clearly understood. In this conjunction, it may be noted that the vertical dimension W1 of the door frame is parallel to the machining direction D1, and consequently, it may equally well be noted that frame locking pins 34 are movable parallel to the vertical machining direction D1 of the door frame, behind door fastening hooks 36, for mutual gripping of these.

In addition, the frame 19 of the machining equipment is provided with guide pins or guide rolls 35, whose axial line is perpendicular to the above height W1 of the door frame and machining direction D1, there being at least one of these on either side of frame 19. The axes of these guide rolls are mutually parallel and parallel to the plane of sealing surface 13 to be machined. In this case, guide rolls 35 will be placed against the upper surface of guides 38 on either side 11*a* and 11*b* of door frame 10, the weight of the frame and the machining equipment being directed through guides 38 to the rigid construction part of the door frame, such as the flanges of the door frame. In this way, the weight of the machining equipment will not entail deformation of the sealing surface to be machined, and the machining equipment will be correctly positioned in vertical direction W1, in the centre of the door frame. In addition, the frame 19 of the machining equipment has adjusting pins 39, whose projection can be set for instance by means of a suitable nut and screw arrangement in a direction D3 perpendicular to the plane of sealing surface 13, as indicated in FIG. 1. Adjusting pins 39 are used to set the correct distance from machining device 23 to the sealing surface 13 to be machined, with a view to provide the desired machineability. These adjusting pins 39 are typically set against the flange 64 of the door frame, but may set at any suitable point, depending on the design of door frame 10. The frame 19 of the machining equipment and the door frame 10 can, of course, be connected to each other and mutually adjusted into correct position by many other means than those described above, all of these means being included in the scope of protection of the claims of this patent application. Thus, the door frame may be equipped with separate fastening points, independent of the fastening points of the oven door, for attachment of the machining equipment. In this case, the machining equipment will of course be provided with fastening means matching these separate fastening points.

The machining device 23 in accordance with the invention, which is fixed to frame 19, has moving means 27, 28 for moving at least one machining unit 1 and/or 2 or generally two machining units 1, 2. Machining units 1, 2 can be moved by these moving means 27, 28 in at least two directions D1 and D2 relative to frame 19. The one or two machining units have a machine tool 3 of their own, and in each machining unit, this machine tool has an actuator 14 of its own to generate the power required for the machining process.

Figure 2:
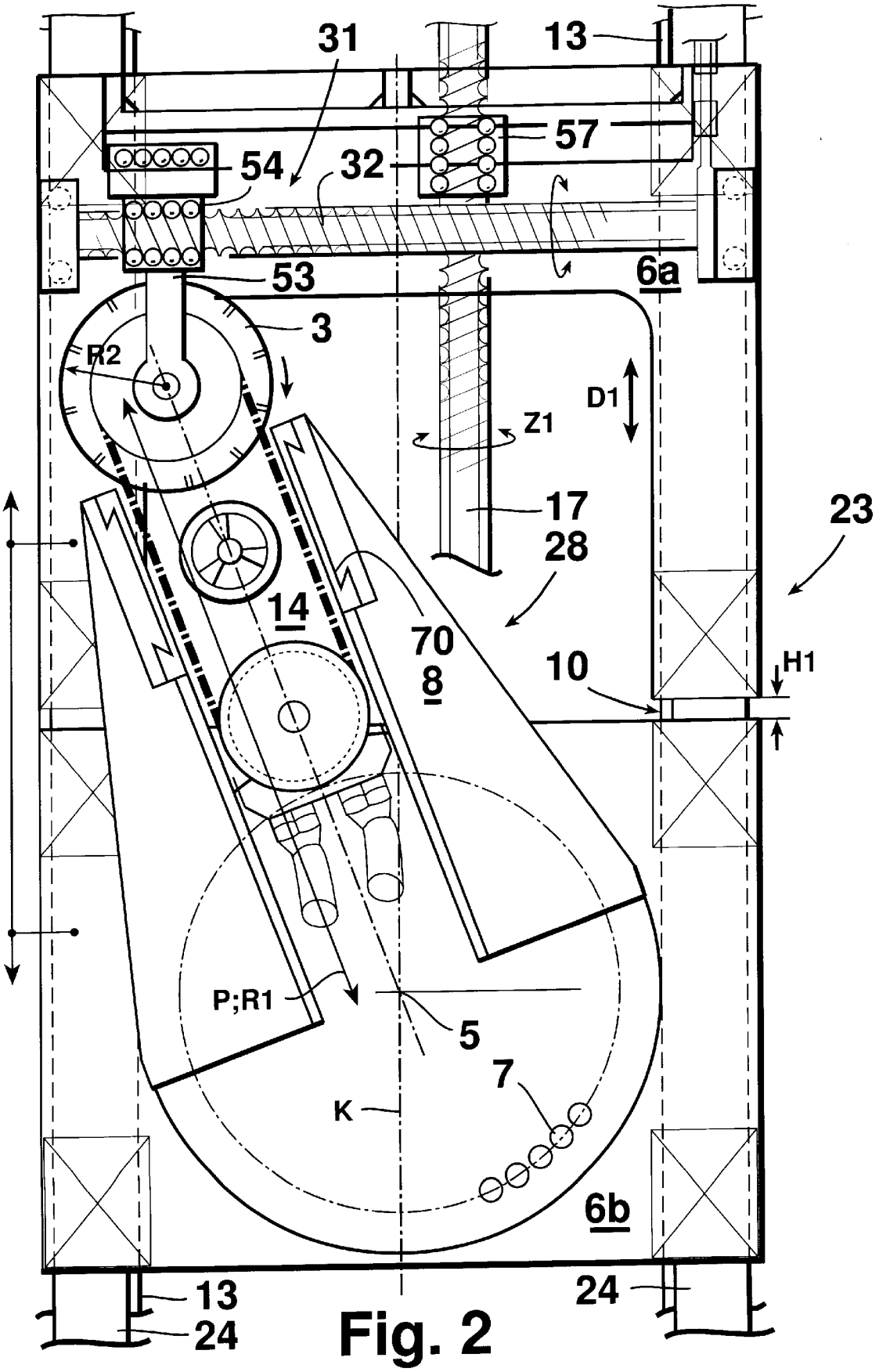
FIG. 2 shows details of the equipment of FIG. 1 in direction III of FIG. 1. The figure shows one machining unit of the machining equipment in accordance with the invention in the position in which the machining tool operates at the comer of the door frame.
Figure 3:
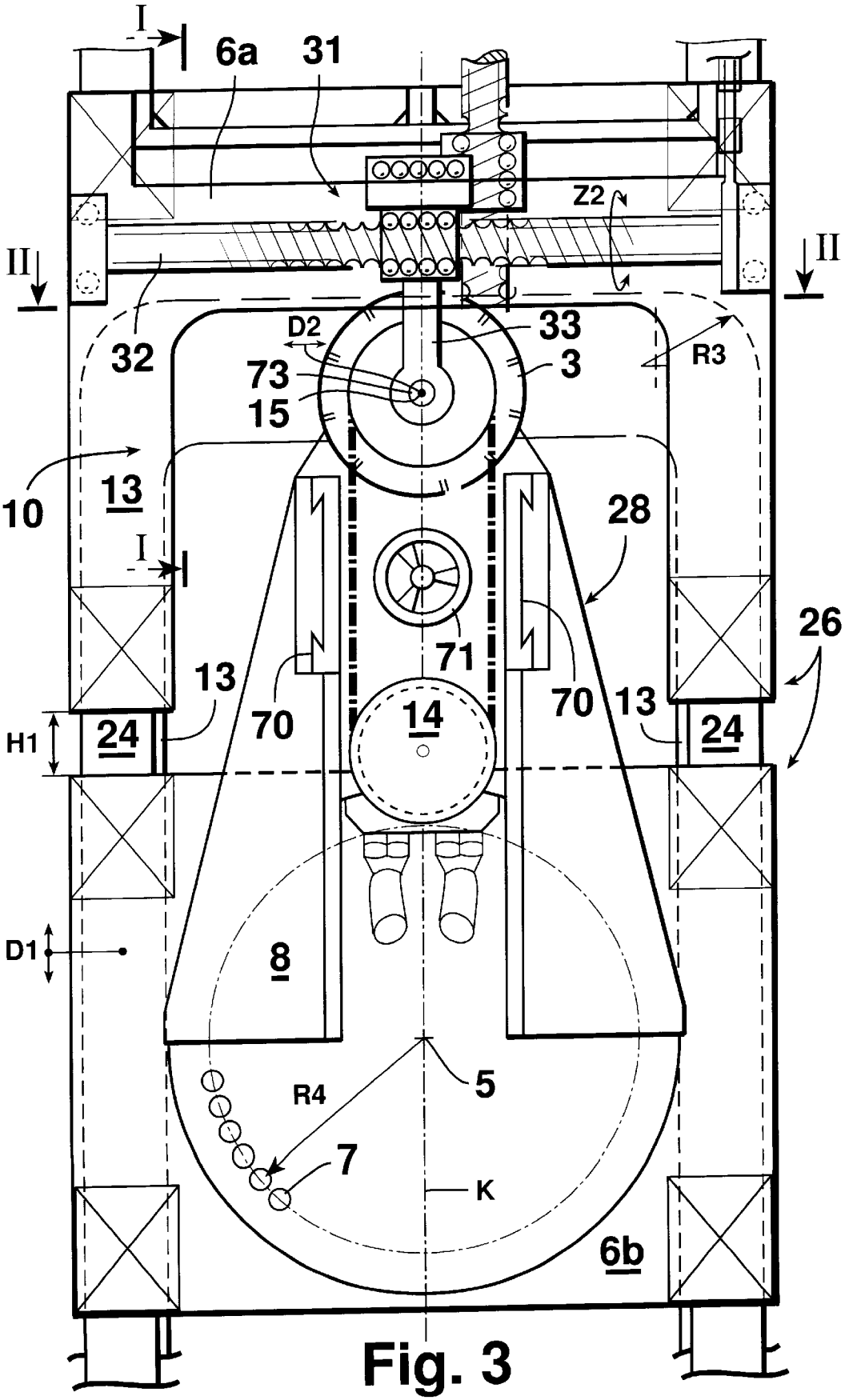
FIG. 3 shows the same detail of the equipment of FIG. 1 in the same projection as FIG. 2 in direction III of FIG. 1. In this figure, the machining unit is in the position in which the machine tool operates in the central area of the upper edge of the door frame.
Figure 4:
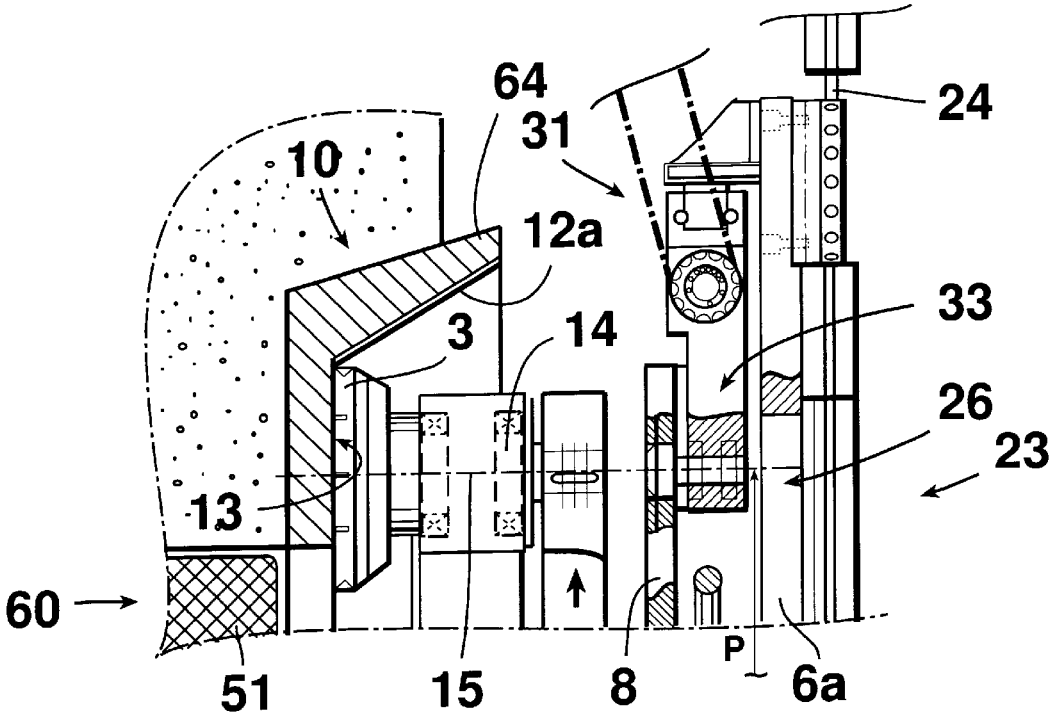
FIG. 4 shows the machining unit in accordance with the invention in operation in the direction of the sealing surface of the door frame to be machined, viewed as a section along plane I—I of FIG. 3.

To move machining units 1 and/or 2 relative to the frame as described above in two directions D1 and D2, machining device 23 comprises guide means 24 in the direction of at least one side 11*a*, 11*b* of the door frame and usually in the direction of the height W1 of the door frame, which, as shown in FIGS. 1–3, usually are two rails, mutually parallel and thus parallel to the height W1 of the door. For each machining unit 1 and 2 sledge means 26 are provided, consisting, in the direction of guide means 24, of two successive sledges 6*a* and 6*b*, which thus, through appropriate slides, may slide on rails forming guide means 24 in the height direction W1 of the door, which is simultaneously one of the above machining directions D1.

In the following description, we shall mainly focus on the operation and the components of the first machining unit 1, however, all the definitions of this also relate to a potential second machining unit 2, indicated with a dashed line in FIG. 1. The sole difference between these machining units 1 and 2 is their different position, i.e. mutually mirror-like relative to a plane perpendicular to the length of the guide means 234 inbetween and thus to the height W1 of the door. In any other respect, the description of machining unit 1 thus also applies for machining unit 2.

In accordance with the invention, means 27 moving the sledge means, which form the bearing parts of the first machining unit 1, in direction D1, consist of one or more vertical guide screws 17, such as ball screws. This vertical guide screw 17 is connected to the first one 6*a* alone of the successive sledges mentioned above, as shown in FIG. 2. The figure distinctly shows the rotating guide screw 17 and arrow Z1 illustrating its rotating movement. Vertical guide screw 17 is connected to the first slegde 6*a* for instance by ball intermediation 57, so that the rotation of the vertical screw guide in direction Z1 will move the first sledge in either of directions D1, depending on the rotation direction. Vertical guide screws 17 are illustrated schematically over their greater length in FIG. 1. Vertical guide screws 17 will naturally require an actuator attached to frame 19, however, since this may be of any adequate type, there is no need to describe it in greater detail here. It is also obvious that more than one vertical guide screw 17 may be used for moving the first sledge 6*a* in directions D1.

In the first machining unit 1 and, of course, in any second machining unit 2, dovetail joints 70 are provided to allow a movement perpendicular to the plane of pivot plate 8, i.e. in direction D3 mentioned above, and usually there are two such dovetail joints symmetrically disposed on either side of the distance R1 between machine tool 3 and the swivelling axis line 5 of the pivot plate. In addition, the pivot plate includes an adjusting wheel 71, by means of which the correct and desired machining depth, i.e. cutting thickness, of machine tool 3, i.e. usually a cutter, is fine-adjusted in direction D3 perpendicular to sealing surface 13. Consequently, adjusting pins 39 mentioned above are used for coarse setting of the machining equipment in direction D3, whereas, at this point, the adjusting wheel and dovetail control 70 mentioned here are used for exact positioning of the machining cutter to achieve the desired cutting depth and thus a planear sealing surface. The mechanism for setting machine tool 3 in direction D3 by means of adjusting wheel 70 may consist of any suitable, conventional engineering components, such as toothed wheels, toothed bars, levers, eccentrics, etc.

In addition, the first machining unit comprises means 28 which move machine tools 3 in a second direction D2 essentially perpendicular to the direction of guide means 24. These means 28 consist of a continuous pivot plate 8 pivoting about swivelling axis line 5, perpendicular to plane T formed by guide means 24 such as vertical bars, and supporting machine tools 3 and their actuator 14, and of the rotation gear 31 for the pivot plate. Thus, the machine tools and their actuators 14 are advantgeously fixed to one rigid and uniform pivot plate 8, which pivots about swivelling axis line 5 by means of rotation gear 31. This rotation gear 31 rotates the machine tools essentially in direction D2, which is principally transverse to the first direction D1 determined by guide means 24. Since this second movement direction D2 takes places about swivelling axis line 5, the movement will not be quite linear with regard to the axis line, but a movement corresponding to a circular arc, whose linearity will depend on the distance R1 between the rotation axis line 15 of the machine tool and said swivelling axis line 5, as will be explained below. However, this apparent motional curvature can be fully rectified, as explained below.

The special feature of the invention for moving machine tools in said transverse second direction D2 is based on the fact that the actual moving means 28, i.e. rotation gear 31, is fixed to a first sledge 6*a* and the axis meachanism 37, with pivot plate 8 pivoting about its swivelling axis line 5, is fixed to the other of said sledges 6*b*. In other words, axis mechanism 37 is located between pivot plate 8 and this second sledge 6*b*. The first and second sledge are not interconnected in any other way, the first sledge 6*a* being moved in the first direction D1 by moving means 27, such as vertical guide screws, whereas the second sledge 6*b* is freely moving on guide means 24, such as vertical rails. The first sledge 6*a* and second sledge 6*b* are thus interconnected only by the intermediation of pivot plate 8 and its journals. The reason for this is the following. Because the upper edge 12*a* and lower edge 12*b* of the door frame 10 are straight as such, as is understood from FIG. 1 and especially FIG. 2, and because machine tool 3 moves about swivelling axis line 5 by the intermediation of gear 31 moving the pivot plate in the transverse second direction D2, whereby machine tool 3 apparently follows a curved path, whose radius is determined by the distance R between the rotation axis line 15 of the machine tool and the swivelling axis line 5 of pivot plate 8, machine tool 3 must be made to follow a straight line in order to machine a straight portion of sealing surface 13 parallel to transverse edge 12*a*, 12*b*. This means that in the first machining direction D1 of the rotation axis line 15, i.e. at height W1 of the door frame, the machine tool must remain at a constant height, so that the distance between swivelling axis line 5 and rotation axis line 15 in direction D1, W1 must vary as machine tool 3 moves in the second machining direction D2. In this case, the distance between the second sledge 6*b* and the first sledge 6*a* must vary accordingly. This difference is clearly seen when FIG. 2 is compared with FIG. 3. In FIG. 2, the machine tool is at the side of the door frame, the distance H1 between the sledges being short, because the machine tool is located laterally of the central line K between the door jambs. In FIG. 3, again, machine tool 3 is exactly at the central line K between the opposite upright sides 11*a* and 11*b* of the door frame, distance H1 between the sledges being at its maximum. If, in the situation of FIG. 3, the machine tool is assumed to move, say, to the right-hand corner 63 of door frame 10, marked with radius R3, machine tool 3 must move along a horizontal line to this point. Because the distance R between the rotation axis line 15 of the machine tool and swivelling axis line 5 of the pivot plate 8 is constant due to the uniformity of pivot plate 8, the second sledge 6*b* must rise upwards for the dimensions and positions of the components to match. In this situation, the second sledge 6*b* is in the position of FIG. 2 and the distance H1 between the sledges is at its minimum. Unlike FIG. 2, machine tool 3 alone would be on the side of the right-hand edge 11*b* of the door frame in this situation.

The operation of machining unit 1 and/or 2 described above is based on the fact that the machining point or machining area of machine tool 3 and especially the rotation axis line of the machine tool is at a distance R1 parallel to the surface 13 of the door frame to be machined from the swivelling axis line 5 of the pivot plate. In a typical case, the rotation axis line 15 of the machine tool is parallel to the swivelling axis line 5 of the pivot plate, so that the distance R1 between these axis lines is parallel to the surface to be machined. With this design, machine tools 3 including their actuators 14 are also fixed to pivot plate 8 in mutually constant positions, so that a perfectly solid construction relative to machining forces is achieved. If, in addition, the distance R1 between the rotation axis line of the machine tool and the swivelling axis line 5 of the pivot plate is arranged to be relatively large relative to the radius R2 of the machine tool, the pivot plate and the associated rotation gear will provide an extremely solid construction, perfectly resistant to machining forces. The construction is further solidified if the axis mechanism 37 formed by the swivelling axis line 5 of the pivot plate 8 is formed to have a radius R4 as large as possible, i.e. in this case, close to half of the horizontal width W2 of the door frame. The ball circumference shown in the figures is suitable for this purpose.

Rotation gear 31, moving machine tool 3 in a direction D2 principally transverse to the direction D1 of the guide means 24, is advantageously formed of horizontal guide screws 32, which are rotated in direction of rotation Z2 and connected with joint 33 to pivot plate 8 at a distance P from the swivelling axis line 5 of the axis meachanism of pivot plate 8. In the embodiment of the figures, the distance P between this joint 33 and swivelling axis line 5 is equal to the distance R1 between the rotation axis line 15 of the machine tool and the swivelling axis line. However, this is not necessarily the case, the distance P between the joint 33 and the swivelling axis line 5 of the axis mechanism may be either greater or smaller than the distance R1 discussed above. Nonetheless, an advantageous and simple solution consists in connecting the swivelling axis of joint 3 with the rotation axis 15 of the machine tool 3 by means of any suitable design, which needs not to be described more in detail here. Hence, in a preferred design, the rotation axis line 15 of the machine tool joins the axial line of the joint pin 73 of the joint 33. The shank 53 of the joint 33 is moved for instance by a ball nut mechanism 54 and any suitable mechanism generating a rotational movement. The rotation of ball nut mechanism 54 moves the shank 53 of the joint 33 in direction D2, thus generating a linear machining movement parallel to the width B2 of the door frame. It is this control which provides the desired linearity in direction D2, and the changes of this caused by a shift in the swing angle of pivot plate 8 are compensated by the movement perpendicular to this of the second sledge 6*b*, i.e. movement D1 parallel to the height W1 of the door frame, which alters the distance H1 between the first sledge 6*a* and the second sledge 6*b*.

As mentioned in the beginning of this disclosure, in equipment for machining the sealing surface 13 of the door frame of a coke oven, it is advantageuos to use a second machining unit 2, which is of the same type as the first machining unit 1 described above. This second machining unit is advantageously set to move on the same guide means 24 parallel to at least one side 11*a*, 11*b* of the door frame, such as rails, as said first machining unit 1. However, this second machining unit is positioned mirror-like relative to a plane perpendicular to the direction of the height W1 of the door frame, and it is fastened to sledge means in a corresponding mirror-like position, i.e. to first sledge 6*a* and second sledge 6*b*. In the first machining unit 1 at the first end 12*a* of the door frame 10, the swivelling axis line 5 of pivot plate 8 is located away from machine tool 3, which in turn is located at the end of the machining unit which is next to the first end 12*a*. In the machining unit 2 at the second end 12*b* of the door frame, said swivelling axis line 5 of pivot plate 8 is located away from the machine tool 3 of this second machining unit, which, in turn is located next to this second end 12*b*. In this manner, the use of two machining units 1 and 2 in simultaneous operation enables machining of both sealing surfaces 13 at the ends 12*a* and 12*b* of the door frame and the opposite vertical sealing surfaces 13 of the door frame at sides 11*a* and 11*b*. Thus, one clearly uniform and planear sealing surface 13 is obtained, when the frame 19 of the device remains in constant position relative to door frame 10 and the machine tools 3 of the two machining units 1, 2 remain constantly at the adjusted, correct distance from the frame, whereby a sealing surface plane 13 parallel to the frame, i.e. the plane T formed by guide means 24, is obtained. This plane T has, of course, been adjusted with adjusting pins 39 described above in direction D3 to the correct position considering the wear of the sealing surface 13 of the door frame and the position thus required.

A particularly preferred embodiment of the machining equipment of the invention uses an end mill as machine tool 3, whereby the machining surface transverse to its axis line 15 forms the actual tool surface milling the sealing surface 13, and whose cutter radius R2 perpendicular to its rotation axis line 15 is essentially equal to the radius of curvature R3 of the corner of the door frame 10 in the plane of the sealing surface. In this manner, the areas of the sealing surface 13 in the corner areas 63 of the door frame will also become planear by machining, without the other parts of the door frame being damaged.

The machining equipment in accordance with the invention further comprises an adapter 40 separate from the elements described above, including gripping means 41 for connection to the frame 19 of the machining equipment. These first gripping means 41 may be pins to be locked to frame 19 as shown in FIG. 1. This adapter is appropriately formed relatively long in the direction of the height W1 of the door frame, so that frame 19, which is long in this direction, and the equally long machining device 23 including its two machining units 1 and 2 are firmly gripped. In addition, the adapter comprises second gripping means 42, allowing the machining equipment to be gripped by some external conveying equipment, such as any other actuator operating in connection with the coke battery, for instance a device for removing doors 45. With this external conveyance equipment and the intermediation of adapter 40, the machining equipment of the invention may be moved with the aid of frame 19 to the door frame to be machined each time, and removed from the door frame once the machining operations have been accomplished. The design described here provides machining equipment which is thin enough in a direction perpendicular to the sealing surface of door frame 10 to allow the other actuators and operating tools of the coke battery to pass freely by it, so that the entire coke battery can be continuously in normal operation.

As stated above, machining unit 1 and/or 2 is moved in the direction of the plane formed by sealing surface 13 of the door frame, the plane having first been roughly set with adjusting pins 39 in direction D3 with the aid of frame 19 of the machining equipment parallel to the sealing surface, and subsequently with the aid of hand wheel 71 and an associated mechanism not shown in the figures, under the control of dovetail joint 70 allowing a sliding movement perpendicular to the sealing surface, exactly in direction D3, parallel to the final plane desired for sealing surface 13. Depending on the accuracy required and the amount of material to be removed, the machining may be performed either in one single operation using one set of machine tools 3, or for instance in two machining operations, the first operation using coarser crushing machine tools 3 and the second operation fine machine tools 3 leaving a finer and smoother trace. However, the use of one single machine tool in one single machining operation is usually sufficient.

In accordance with the invention, the movement of machine tools 3 of machining unit 1 and/or 2 is controlled as follows during the machining operation. For instance an upper, first machining unit 1 is first fed on the sealing surface 13 corresponding to either of the first vertical sides 11*a* or 11*b* of door frame 10 in direction D1, and immediately after this, without stopping the device, in direction D2 of the sealing surface portion parallel to door frame 10 transverse to this first side, and after this, in direction D1 of the third side of the door frame at least principally parallel to the first side 11*b* or 11*a* respectively, on sealing surface 13. This is the order of operations when the first machining unit has been placed on the side of the upper side 12*a* of the door frame. If the first machining unit has ben placed in the area of the lower end 12*b* of the door frame, the order of operations will of course respectively be first in direction D1 of the first side 11*a* or 11*b*, then in direction D2 of the second side 12*b* perpendicular to this, and finally on sealing surface 13 in direction D1 parallel to the third side 11*b* or 11*a* respectively. The machine tool 3 of the second machining unit 2 that may be included in the machining equipment of the invention is controlled in exactly the same way. If, as indicated in FIG. 1, this machining unit 2 is located on the side of the lower edge 12*b* of door frame 10, the machine tool will first work sealing surface 13 parallel D1 to the first or third side 11*a* or 11*b* of the door frame, then the sealing surface parallel D2 to the fourth side 12*b* of the door frame transverse to this side, and finally parallel D1 to side 11*b* or 11*a* respectively of the door frame principally parallel to the first side. If, on the other hand, this second machining unit is placed on the side of the upper edge 12*a* of the door frame, the machining will first take place in direction D1 on the side of side 11*a* or 11*b* of the door frame, then in direction D2 parallel to transverse side 12*a*, and finally in direction D1 parallel to side 11*b* or side 11*a* respectively. This second machining unit 2 is also in continuous, uninterrupted operation during the machining operations in all three directions and also during changes of direction, exactly as machining unit 1.

If, for some reason, one single machining unit is to be used in the machining equipment instead of the two machining units 1 and 2 described above, the machinery has to be complemented with a rotating device, which rotates this single machining unit 180° in the plane of guide means 24, to enable machine tool 3 to work both the portion of sealing surface 13 transverse at width W2 at the upper edge 12*a* of the door frame and the portion of sealing surface 13 transverse at width W2 at the lower edge 12*b* of the door frame. Such a solution results in considerably more complex machining equipment, and is thus hardly advantageous. A second, slightly simpler solution consists in the use of machining equipment otherwise of the type described above, provided with one single machining unit 1 or 2, but using it in a specific manner. When such machining equipment has first been attached by its frame 19 to door frame 10 such that one machining unit 1 or 2 of the machining device has worked at least half of sealing surface 13 to become planear as desired and with the desired accuracy in a first step, the machining equipment is detached from door frame 10 and the entire machining equipment is turned 180° in the plane of the sealing surface and thus also approximately in plane T, and after this the machining equipment is attached by its frame 19 to door frame 10 anew. After this, machining unit 1 or 2 will thus be upside down compared with its position in the first step, so that the machining unit can work at least the other half of sealing surface 13. In this manner of operation, the entire machining equipment is thus operated in two positions turned 180° upside down relative to each other. This solution involves simple equipment, but requires the step of turning the equipment.

I claim:

1. Machining equipment for machining a sealing surface of a door frame of a coke oven, comprising:

a machining device movably attached to a machine frame, said machining device including at least one machining unit having a machine tool and driving means for driving said machine tool;

means for moving said at least one machining unit relative to said machine frame in at least two directions;

connection means on said machine frame for attaching the machine frame to fastening points on the door frame of the coke oven while the door frame is being machined, said machining device being provided with guide means parallel to at least one side of the door frame and with sledge means comprising first and second sledges successively located and movable in a first direction along said guide means, said means for moving said machining unit including first moving means for moving said sledge means along said guide means in said first direction; and said machining unit further comprising a mechanism on said second sledge forming a swiveling axis line perpendicular to the plane of said guide means, and a uniform pivot plate pivotable about said swiveling axis line for supporting said machine tool, said means for moving said machining unit including second moving means for shifting said machine tool in a second direction essentially transverse to said first direction, said second moving means including a swivel gear located on said first sledge.

2. Machining equipment according to claim 1, wherein said sledge means comprises two sledges for each machining unit arranged successively in the direction of said guide means, a first of said sledges being operated by said first moving means for moving said sledge means along said guide means in said first direction, said second moving means being attached to said first sledge; said mechanism comprises an axis mechanism connected to a second of said sledges for allowing pivoting about said swiveling axis line, said axis mechanism being located between said pivot plate and said second sledge; and said driving means comprises tool driving means supported on said pivot plate.

3. Machining equipment according to claim 1 or 2, wherein said first moving means is connected to said first sledge alone, said second sledge moves freely on said guide means, and said machine tool has a working area having a radius from said swiveling axis line, said radius being parallel to the surface of the door frame to be machined.

4. Machining equipment according to claim 1 or 2, wherein said machine tool has a rotation axis line parallel to said swiveling axis line, the distance between said axis lines being parallel to the surface to be machined, said machine tool and said driving means being attached in constant position to said pivot plate.

5. Machining equipment according to claim 2 wherein said axis mechanism is a ball-bearing-circumference, said first moving means moving said sledge means in said first direction includes one or more vertical guide screws, said swivel gear moving said machine tool in said second direction includes horizontal guide screws articulated on said pivot plate at a distance from the swiveling axis line of said axis mechanism, and said machine tool has a rotation axis line in register with a swiveling axis line of a joint pin of an articulation between the pivot plate and the swivel gear.

6. Machining equipment according to claim 1, wherein said connection means for connecting said machine frame to the door frame of the coke oven comprises locking pins movable parallel to the sides of the door frame for gripping hooks at the fastening points in the door frame, guide elements in said machine frame, and protruding guides in the door frame for supporting said guide elements, and wherein said machine frame further comprises adjustment pins for distance positioning thereof, said adjustment pins having a protrusion adjustable in a third direction perpendicular to the surface of the door frame to be machined.

7. Machining equipment according to any of claims 1, 2 or 6, wherein said equipment for machining the sealing surface of the door frame of a coke oven further comprises a second machining unit of the same type as said one machining unit mounted to move on said guide means parallel to at least one side of the door frame as said one machining unit, said second machining unit being attached to second sledge means positioned and attached in mirror-relation to the position and attachment of the first machining unit and first sledge means.

8. Machining equipment according to any of claims 1, 2 or 6, comprising at least two machining units, a first of said machining units having a first machine tool arranged at a first end of the door frame and having a swiveling axis line located away from both said first machine tool and said first end of the door frame, and a second of said machining units having a second machine tool arranged at a second end of the door frame and having a swiveling axis line located away from both said second machine tool and said second end of the door frame.

9. Machining equipment according to claim 1, wherein said machine tool is an end mill having a cutter radius extending from the rotation axis line essentially equal to a radius of curvature of a corner of the door frame in the plane of the sealing surface to be machined.

10. Machining equipment according to claim 1, further comprising a separate adapter, said adapter having first gripping means for connection to said machine frame and second gripping means for connection to an external conveyance equipment, for transferring said machining equipment to a door frame to be machined and removing said machining equipment from the door frame after the door frame has been machined.

* * * * *